United States Patent [19]

Ruffner

[11] Patent Number: 4,800,593

[45] Date of Patent: Jan. 31, 1989

[54] PROTECTIVE GARMENT FOR WEIGHT LIFTERS

[76] Inventor: John J. Ruffner, 21438 Ellen Dr., Fairview Park, Ohio 44126

[21] Appl. No.: 141,800

[22] Filed: Jan. 11, 1988

[51] Int. Cl.[4] ..... A41D 13/00

[52] U.S. Cl. ..... 2/108; 2/102; 2/94; 2/92; 2/44; 2/45

[58] Field of Search ..... 2/2.0, 2.5, 44, 45, 2/86, 92, 94, 96, 102, 108

[56] References Cited

U.S. PATENT DOCUMENTS

| | | | |
|---|---|---|---|
| 1,489,048 | 4/1924 | Whitley | 2/92 |
| 2,517,615 | 8/1950 | Webster et al. | 2/2.5 |
| 2,747,190 | 5/1956 | Foster. . | |
| 2,748,391 | 6/1956 | Lewis, Jr. et al. | 2/2.5 |
| 3,158,872 | 12/1964 | Pantzke | 2/115 |
| 3,582,988 | 6/1971 | Armellino | 2/2.5 |
| 3,885,248 | 5/1975 | Salsby | 2/94 |
| 4,100,620 | 7/1978 | Pecoraro | 2/2 |
| 4,195,362 | 4/1980 | Rolando | 2/108 |
| 4,217,663 | 8/1980 | Goldberg et al. | 2/86 |
| 4,343,045 | 10/1982 | Ferrari | 2/92 |
| 4,507,801 | 4/1985 | Kavanagh et al. | 2/267 |

*Primary Examiner*—Werner H. Schroeder
*Assistant Examiner*—Jeanette E. Chapman
*Attorney, Agent, or Firm*—Henderson & Sturm

[57] ABSTRACT

A protective garment construction (10) for weight lifters comprising a jacket member (13) having a plurality of internal compartments (30) which are dimensioned to receive a plurality of padded members (40) including: a neck pad member (41); an upper back pad member (42); a pair of shoulder pad members (43); and, a pair of upper chest pad members (44); wherein, the padded jacket member (13) prevents a metal bar (100) from bruising the neck and upper torso of a weight lifter during normal weight lifting exercises.

3 Claims, 1 Drawing Sheet

PROTECTIVE GARMENT FOR WEIGHT LIFTERS

TECHNICAL FIELD

This invention relates in general to articles of protective sportswear and in particular to a padded jacket construction to protect areas of the body which may be injured while lifting weights.

BACKGROUND OF THE INVENTION

As can be seen by reference to the following U.S. Pat. Nos.: 4,343,045; 1,489,048; 3,158,872; and 3,885,248, the prior art is replete with myriad and diverse specialized sportswear constructions for various specific activities and uses.

While the prior art constructions are more than adequate for the purpose and function for which they were specifically designed, none of these constructions address or provide the protection needed by a weight lifter.

One of the most important exercises in weight lifting is the squat. This exercise involves lifting and lowering several hundred pounds of weights, with weights on a metal bar which rests directly on the shoulders. This contact and the constant movement involved can cause painful bruises, blisters, rashes, callouses, and blood blisters on both the neck, back and shoulders of a weight lifter. In addition, there are numerous other weight lifting exercises which bring the metal bar directly and/or repeatedly into contact with the weight lifter's chest.

Obviously there has been a longstanding need for a protective article of clothing for weight lifters that would eliminate these injuries. The development of such a construction is the stated purpose and objective of the present invention.

BRIEF SUMMARY OF THE INVENTION

The protective garment construction that forms the basis of the present invention comprises in general a jacket unit and a padding unit. The jacket unit comprises in general a sleeveless jacket member having a closure means; wherein the jacket member is further provided with a plurality of segregated compartments disposed in the upper portion of the jacket construction.

The padding unit comprises in general a plurality of cushioned members in the form of individual contoured pad elements which are dimensioned to be received in the plurality of segregated compartments of the jacket member to provide padded protection for the user's neck and upper torso.

Briefly stated, the aforementioned arrangement provides protection for the shoulders, neck and upper body areas of a weight lifter, whereby the weight lifter will not be susceptible to bruising or other similar injuries.

BRIEF DESCRIPTION OF THE DRAWINGS

These and other objects, advantages, and novel features of the invention will become apparent from the detailed description of the best mode for carrying out the preferred embodiment of this invention which follows, particularly when considered in conjunction with the accompanying drawings, wherein.

BEST MODE FOR CARRYING OUT THE INVENTION

Figure 1:
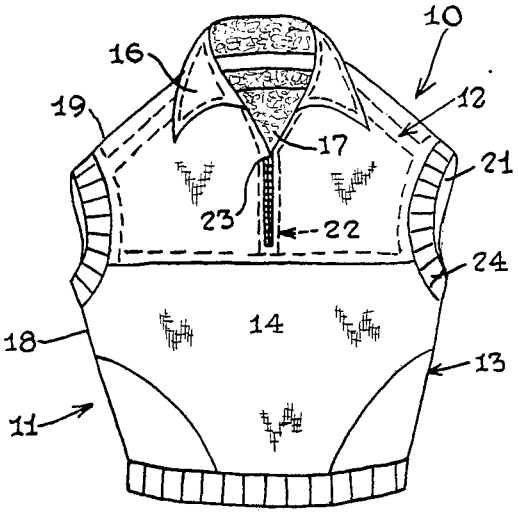
FIG. 1 is a front plan view of the exterior of the weight lifters jacket.

As can be seen by reference to the drawings, and in particular to FIG. 1, the protective garment construction of this invention is designated generally by the reference numeral (10). The garment construction (10) comprises in general a garment unit (11) and a padding unit (12). These units will now be described in seriatim fashion.

Figure 2:
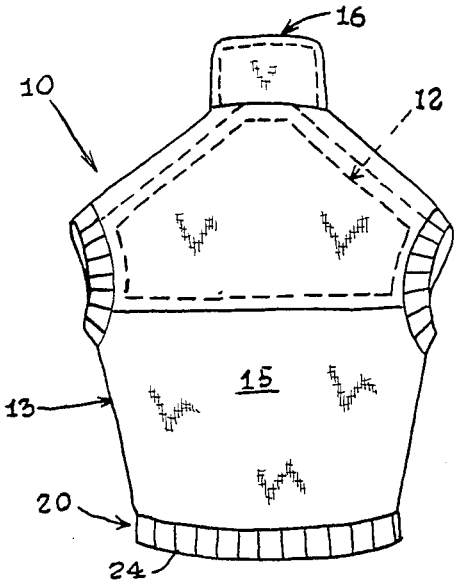
FIG. 2 is a rear plan view of the exterior of the weight lifters jacket.

As shown in FIGS. 1 and 2, the garment unit (11) comprises in general a jacket member (13) having: a front panel segment (14); a back panel segment (15); and, a raised collar segment (16) surrounding a throat opening (17).

As can be seen by reference to FIGS. 1 thru 4, the front (14) and back (15) panel segments are joined along their common outboard (18) and upper (19) edges to create a body opening (20) and a pair of side arm openings (21); wherein, the collar segment (16) is operatively connected to both the front (14) and back (15) panel segments around the periphery of the throat opening (17).

In addition, the front panel segment (14) is provided with a closure member (22) that controls an elongated vertical opening (23) which extends from the throat opening (17) to a point proximate the body opening (20). Furthermore, the periphery of both the side arm openings (21) and the body opening (20) may be provided with elasticized bands (24) to give a snug fit of those portions of the sleeveless jacket member (13) relative to a user's upper torso (not shown) in a well recognized manner.

Figure 3:
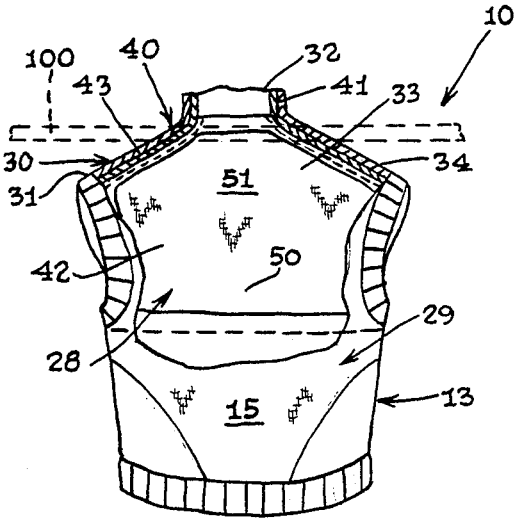
FIG. 3 is a cutaway view of the upper rear portion of the weight lifter's jacket.
Figure 4:
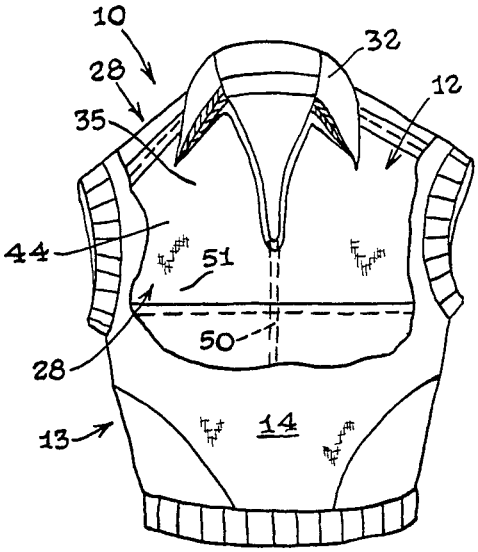
FIG. 4 is a cutaway view of the upper front portion of the weight lifter's jacket.

Turning now particularly to FIGS. 3 and 4, it can be appreciated that the upper portion (28) of both the front (14) and back (15) panel segments are provided with a plurality of compartments (30) formed by joining the opposed surfaces of an inner and outer layer (31) of fabric used to fabricate the upper portions (28) of the respective segments (14, 15).

It should also be noted at this juncture that while the lower portion (29) of the jacket member (13) may coincidentally be fabricated from a double thickness of material, this invention only requires that a single layer (31) of material be employed in the lower portion (29) of the jacket member (13).

As shown in FIGS. 3 and 4, the upper portion (28) of the jacket member (13) is provided with: a neck compartment (32); an upper back compartment (33); a pair of shoulder compartments (34); and, a pair of upper chest compartments (35).

As can also be appreciated by reference to FIGS. 3 and 4, the padding unit (12) comprises in general a plurality of padded members (40) that are dimensioned and conformed to substantially occupy the plurality of compartments (30) that are formed in the upper portion (28) of the jacket member (13). Consequently the padded members (40) comprise: a neck pad member (41); an upper back pad member (42); a pair of shoulder pad members (43); and, a pair of upper chest pad members (44).

As shown in FIGS. 3 and 4, the padded members (40) of the preferred embodiment are fabricated from a layer (50) of quilted material (51) that will have sufficient thickness to provide padded protection for the user's neck, shoulders, and upper torso; while still retaining the degree of flexibility required for a weight lifter to perform various lifting exercises.

In an alternate embodiment of the invention (shown in phantom), the front panel segment (14) does not have an elongated vertical opening (23) that divides the upper portion (28) of the front panel segment into a pair of chest compartments (35); leaving a single compartment (35') that requires only a single chest pad member (44').

At this juncture it should be appreciated that the protective garment construction (10) of this invention produces a padded jacket member (13); wherein, the padded members (40) are concentrated in those areas of the user's neck and upper torso which would be subject to abrasions and/or bruises from contact with the metal bar (100) (shown in phantom) that supports the weights. It should also be appreciated that the compartmentalized construction of the upper portion (28) of the jacket member (13) tends to immobilize the padded members (40) within their respective compartments (30), such that the garment construction (10) will retain an aesthetically pleasing appearance. In addition, the quilted nature of the padded members (40) substantially eliminates the possibility that the padding will settle in the individual compartments (30) to give the jacket member (13) a lumpy appearance.

Having thereby described the subject matter of this invention it should be apparent that many substitutions, modifications, and variations of the garment construction are possible in light of the above teachings. It is therefore to be understood that the invention as taught and described herein, is only to be limited to the extent of the breadth and scope of the appended claims.

I claim:

1. A protective garment construction for weight lifters to prevent bruises and abrasions on the weight lifter's neck, shoulders and upper torso from contact with a metal bar during weight lifting exercises; wherein, the protective garment constructions consists of:

a garment unit comprising a sleeveless jacket member having a front panel segment, a back panel segment and a raised collar segment surrounding a throat opening wherein each of the segments is provided with an inner and an outer layer of fabric whereby the upper portion of the front and back panel segments are provided with a plurality of compartments that are formed by joining the inner and outer fabric layer; and, wherein the raised collar segment is also provided with a compartment that is formed by joining the inner and outer fabric layers of the raised collar segment; and, wherein said plurality of compartments consists of a single upper back compartment; a neck compartment; a pair of shoulder compartments; and, at least one upper chest compartment covering at least one side of the upper portion of the user's torso; and, a padding unit comprising a plurality of individual padded members that are dimensioned and conformed to occupy the said plurality of compartments that are formed in the upper portion of the front and back panel segments and the raised collar segment wherein the said plurality of padded members comprise: a neck pad member; an upper back pad member; a pair of shoulder pad members; and at least one upper chest pad member; wherein, said padded members are concentrated in the upper portion of the sleeveless jacket member.

2. The protective garment construction as in claim 1, wherein the jacket member is also provided with an elongated vertically disposed opening in the front panel segment which extends downwardly from said neck opening; wherein, the vertically disposed opening divides the front panel segment into a pair of upper chest compartments.

3. The protective garment construction as in claim 2, wherein said plurality of padded members comprises:

a pair of upper chest pad members.

* * * * *